United States Patent [19]

Lutz

[11] 4,454,023

[45] Jun. 12, 1984

[54] PROCESS FOR UPGRADING A HEAVY VISCOUS HYDROCARBON

[75] Inventor: Irvin H. Lutz, Sagamore Hills, Ohio

[73] Assignee: Alberta Oil Sands Technology & Research Authority, Edmonton, Canada

[21] Appl. No.: 477,948

[22] Filed: Mar. 23, 1983

[51] Int. Cl.[3] ..... C10G 67/04; C10G 21/00

[52] U.S. Cl. ..... 208/96; 208/48 R; 208/106; 208/309

[58] Field of Search ..... 208/96, 106, 309, 78, 208/48 R

[56] References Cited

U.S. PATENT DOCUMENTS

| | | | |
|---|---|---|---|
| Re. 27,309 | 3/1972 | Scott et al. | 208/106 |
| 2,500,757 | 3/1950 | Kiersted | 208/309 |
| 2,666,022 | 1/1954 | Johnson | 208/67 |
| 2,900,327 | 8/1959 | Beuther | 208/106 |
| 3,321,395 | 5/1967 | Paterson | 208/78 |
| 3,338,818 | 8/1967 | Paterson | 208/58 |
| 3,412,009 | 11/1968 | Smith et al. | 208/72 |
| 3,413,211 | 11/1968 | Becraft et al. | 208/93 |
| 3,726,787 | 4/1973 | Frazier et al. | 208/59 |
| 3,738,931 | 6/1973 | Frankovich et al. | 208/67 |
| 3,775,292 | 11/1973 | Watkins | 208/86 |
| 3,775,293 | 11/1973 | Watkins | 208/86 |
| 3,907,664 | 9/1975 | Janssen et al. | 208/80 |
| 4,233,138 | 11/1980 | Rollmann et al. | 208/106 |
| 4,239,616 | 12/1980 | Gearhart | 208/309 |
| 4,247,387 | 1/1981 | Akbar | 208/106 |
| 4,264,432 | 4/1981 | Gartside | 208/48 R |
| 4,358,365 | 11/1982 | Hutchings et al. | 208/96 |
| 4,391,700 | 7/1983 | Billow et al. | 208/86 |

OTHER PUBLICATIONS

"Encyclopedia of Chemical Technology" Copyrighted 1968–Kirk–Othmer vol. 15, pp. 18–23.

"Thermal Visbreaking of Heavy Residues—A Modern Application of Thermal Cracking" by H. Beuther, R. G. Goldthwait, and W. C. Offuitt; Gulf Research & Development Co., Nov. 9, 1959.

*Primary Examiner*—Delbert E. Gantz
*Assistant Examiner*—O. Chaudhuri
*Attorney, Agent, or Firm*—Bernard, Rothwell & Brown

[57] ABSTRACT

A process for upgrading a heavy viscous hydrocarbon, for example, rendering a heavy viscous crude pipelinable, includes visbreaking, distillation and solvent extraction steps. A heavy viscous hydrocarbon is fed through the visbreaker which forms a feed to the distillation step. A heavier fraction from distillation is fed to a solvent extraction unit which produces a fraction which contains resin. At least a portion of the resin containing fraction separated in the solvent extraction unit is recycled and combined with the feed which is to be subject to visbreaking so that the total yield of products, residual and gas-free, is increased. The recycled resin reduces the tendency of the asphaltenes to separate from the oil and thereby reduces the tendency to lay down coke in the visbreaker; this allows higher conversion to upgraded liquid products.

21 Claims, 4 Drawing Figures

PROCESS FOR UPGRADING A HEAVY VISCOUS HYDROCARBON

BACKGROUND OF THE INVENTION

1. Field of the Invention

The present invention relates to processes for upgrading heavy viscous hydrocarbons, such as viscous crude oils, bitumens from tar sands, hydrocarbons derived from coal, lignite, peat or oil shale, residuum resulting from the atmospheric and/or vacuum distillation of lighter crude oils, heavy residues from solvent extraction processes, and the like. Such processes include, for example, the treating to reduce the viscosity of heavy viscous crudes which are impractical to pump at ambient temperatures to obtain a product which is practical to pump through conventional pipe lines. Additionally, some of the upgrading processes include reducing the metals, particularly nickel and vanadium, and Conradson carbon content while reducing the specific gravity.

2. Description of the Prior Art

A large number of processes are available for treating heavy, viscous hydrocarbons, such as Boscan crude from Venezuela or Cold Lake crude from Canada, to obtain an upgraded product with lower viscosity, specific gravity, metals content, and Conradson carbon content. Generally these processes may be grouped into two broad classes: (1) the solvent extraction processes which remove high carbon viscous materials and (2) the conversion processes.

The solvent extraction processes rely on physical separation, not chemical conversion. In a typical three-stage solvent extraction process where oils, resins, and asphaltenes are produced as separate fractions, the metals, sulfur, and Conradson carbon contents are highest in the asphaltene fraction, next highest in the resin fraction, and smallest in the oil fraction. The relative amounts of the asphaltene, resin and oil fractions and the corresponding properties thereof, can be varied over a wide range by changing solvents and operating conditions in the solvent extraction unit. When producing a minimum amount of the asphaltene fraction, it generally happens that the metal and Conradson carbon content of the resin fraction is usually increased to the point where the resin fraction is not a desirable material for subsequent catalytic processing such as catalytic cracking or hydrocracking.

In order to produce a solvent extracted oil with acceptable metal and Conradson carbon levels for catalytic processing, it is necessary to limit the yield of the oil fraction and increase the yields of the resin and asphaltene fractions. Since the latter two fractions generally must be used as a residual fuel of very low value, a serious economic penalty on the utilization of solvent extraction processes results.

Similar results are obtained with a two-stage solvent extraction unit. The two-stage unit may be operated to include the resins in varying degrees with the asphaltenes or with the oils. The metals and Conradson carbon contents of the fractions would vary accordingly. It is also possible to operate four or more stages of a solvent extraction unit. Varying cuts can be made depending on operation with the heaviest cuts containing the highest molecular weight materials, the greatest viscosity, and the highest metals and Conradson carbon content.

The second broad class includes processes which convert the high boiling viscous hydrocarbons to lighter products. These conversion processes can be grouped into three categories: (1) processes which employ a high hydrogen partial pressure; (2) thermal cracking processes which prevent coke formation by special design and by limiting conversion; and (3) processes which produce coke.

The thermal cracking processes are generally less expensive than those in the other categories but generally produce a lower yield of residual and gas-free products. "Residual and gas-free products" are defined herein as total products, less (1) $C_2$ and lighter gas, (2) coke, (3) liquid boiling above 1050° F. containing more than 10% Conradson carbon, and (4) Conradson carbon content of other products. The yields of thermal cracking processes are limited by feedstock quality, product quality, and coke formation. For a given feedstock, the greatest conversion may be obtained by increasing the severity to the level where the product quality or rate of coke formation become unacceptable. The rate of coke formation is increased as the resins and high moleculer weight oils, which act to peptize and maintain the asphaltenes dispersed, are cracked. This causes the asphaltenes to become incompatible with the surrounding constituents, to start to form a sediment, to increase in number and/or size due to polymerization and/or condensation reactions, and to increase the rate of coke formation. This also affects the quality of products from thermal cracking processes as the asphaltenes and sediments detract from product quality by adversly affecting product stability and compatability with blending stocks.

Hydroconversion processes generally produce the highest yield of residual and gas-free products, but are also much more costly both from an investment and an operating cost standpoint than thermal cracking processes. The hydroconversion processes require a high investment because a hydrogen production facility is required to supply hydrogen and high hydrogen partial pressure is required in the hydroconversion unit to either suppress coke formation on the catalyst or to accomplish the hydrogen addition noncatalytically. Utilities costs for typical hydroconversion processes are high because of the high cost of hydrogen compression and the multiplicity of steps involved. Additionally, operating costs are increased where high metals content of heavy crudes such as Boscan and Cold Lake result in catalyst deactivation.

In a typical hydroconversion process, the crude is usually subjected to successive atmospheric and vacuum distillation to reduce the amount charged to the very expensive high pressure residual hydroconversion step. This hydroconversion requires that the bottoms from the vacuum distillation be further heated to hydroprocessing reactor temperature. Part of the effluent from the hydroconversion reactor is then cooled to produce a hydrogen recycle stream with low hydrocarbon content. The remaining effluent is then further heated for distillation and followed, in some cases, by solvent extraction to produce a heavy residual together with gas oil and lighter products. These repeated heating and cooling steps result in relatively high investment and operating costs.

Processes such as delayed and fluid coking can be heat integrated to avoid repeated successive heating and cooling steps. However the yield of residual and gas-free products of such coking processes are generally less than hydroconversion processes. Further the olefinic content as indicated by the bromine number of coking products is usually relatively high resulting in a high hydrogen consumption in subsequent refining processes to produce finished products.

SUMMARY OF THE INVENTION

The present invention teaches a process for upgrading a heavy viscous hydrocarbon including visbreaking, distillation, and solvent extraction steps wherein at least a portion of a heavy viscous hydrocarbon is visbroken and fed to a distillation step for fractionation, a heavier fraction for the distillation step is fed to a solvent extraction step and a fraction from the solvent extraction step which contains resins is combined with the feed to the visbreaker to permit higher conversion in the visbreaker.

This process offers a significant yield and quality improvement over processes of similar cost and complexity; furthermore, much lower investment and operating costs are required than for processes which produce similar yields and product quality.

One advantage of the invention is that increased visbreaking conversion is possible due to the increased resin content of the visbreaker feed resulting from this process. During visbreaking, the resins crack at a rate approximately ten times greater than the average of the high molecular weight oils. For this reason it is quite beneficial to have the significantly higher concentration of resins which result from resin recycle, particularly near the outlet of the visbreaking coil, to act as a peptizing agent to help maintain the asphaltenes in suspension and avoid the formation of coke. This allows the visbreaker to be operated at even greater severity allowing even greater conversion rates and thus higher yields of residual and gas free products.

A second advantage of the process of this invention compared to the conventional solvent extraction scheme is improved product quality. A residual and gas-free product can be produced with lower metals and Conradson carbon content and lower viscosity than by the conventional solvent extraction process. Thus, a synthetic crude suitable for pumping through conventional pipelines may be produced in much higher yield than by the conventional solvent extraction process.

A third advantage of the process of this invention is hydrogen conservation. Compared to other thermal cracking and coking processes, the liquid product from the process of this invention has a higher hydrogen content than that of competing processes; thus the downstream hydrotreating costs are significantly less.

Another advantage is the low capital and operating cost which results from utilizing this unique combination of conventional and highly proven process steps with minimal complexity and a high degree of energy efficiency.

Other advantages of the invention will be apparent from the following description of the preferred embodiment taken in conjunction with the accompanying drawings.

DESCRIPTION OF THE PREFERRED EMBODIMENTS

Figure 1:
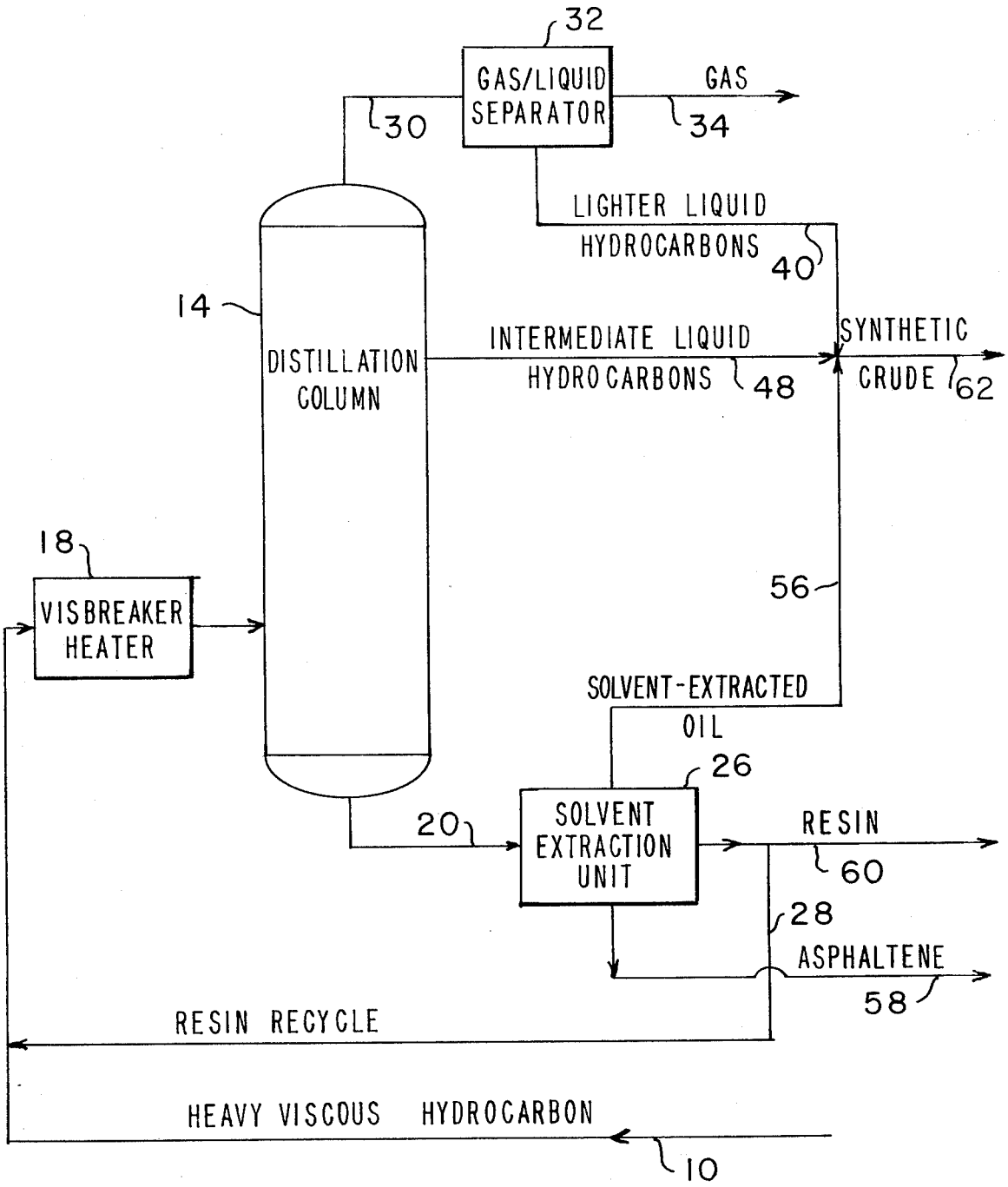
FIG. 1 is a flow diagram of a process for upgrading hydrocarbons in accordance with the invention. This basic flow scheme is particularly suitable for use where the heavy viscous hydrocarbon feed has been previously processed leaving only those components boiling above 650° F. (343° C.) or higher in the feed.

As illustrated in FIG. 1, a heavy viscous hydrocarbon input or feedstock in line 10 is fed through a visbreaker heater 18 into a distillation column 14. Bottoms from the distillation column are withdrawn in line 20 and supplied to a solvent extraction unit 26. Alternatively, the distillation column may be replaced by any other fractionation apparatus, for example those of a centrifugal type fractionating apparatus.

The solvent extraction unit 26 is a conventional plant; for example, such as that illustrated in U.S. Pat. No. 4,239,616, which in a first separation procedure separates asphaltenes from the feed, and in a second separation stage separates resins from the remainder leaving an oil product from which the solvent is separated. The solvent or solvents used and the percent of oil and resin removed from the heavy viscous material are dependent upon the economic yield-product quality relationship for the particular application. Solvents employed may include paraffin hydrocarbons containing from 3 through 9 carbon atoms, such as propane, butane, pentane, hexane, heptane, octane and nonane; and/or mono-olefin hydrocarbons containing from 3 to 9 carbon atoms such as propene, butene, pentene, hexene, heptene, octene and nonene and/or aromatic hydrocarbons having normal boiling points below 310° F. (154° C.) such as benzene, toluene, ortho-, meta- and para-xylene, and isopropyl benzene. In general, the lower boiling paraffin hydrocarbons, such as propane, result in the production of a superior quality oil but of lower quantity. Increasing the boiling range or decreasing the hydrogen content of the solvent results in a decreased yield of asphaltenes and a higher yield of oil of poorer quality.

The solvent extraction unit 26 produces two or more streams depending on the number of stages in the unit. At least a portion of one of the lighter streams which contains resins, the second (resin) stream in a typical three-stage unit, is combined with the material forming the feed for the visbreaker heater 18 where at least a portion of the material is thermally cracked into lighter components. The visbreaker heater effluent is then fed to a distillation column 14 for fractionating. Gas and lighter liquid hydrocarbons are withdrawn in line 30 as overhead from the distillation column 14 and separated by the gas/liquid separator 32 into a gas stream in line 34 and a lighter liquid hydrocarbon stream in line 40. Intermediate liquid hydrocarbons are withdrawn in a side stream in line 48 from the distillation column 14. The three-stage solvent extraction unit 26 shown in FIG. 1, in addition to the resin stream in line 28, produces a solvent-extracted oil stream in line 56 and an asphaltene product stream in line 58. A portion of the resin may be withdrawn as a product stream in line 60. The product streams 40, 48, and 56 may be used individually, or may be combined as shown in FIG. 1 to form a single synthetic crude product stream in line 62.

The present invention can be utilized for upgrading a variety of heavy viscous hydrocarbons including viscous crude oils, bitumens from tar sands, hydrocarbons derived from coal, lignite, peat or oil shale, residium resulting from the vacuum or atmospheric distillation of lighter crude oils, heavy residues from solvent extraction processes, and the like. The basic process illustrated in FIG. 1 is particularly suitable for use where the heavy viscous hydrocarbon feed has been previously processed leaving only those components boiling above 650° F. (343° C.) or higher in the feed.

Figure 2:
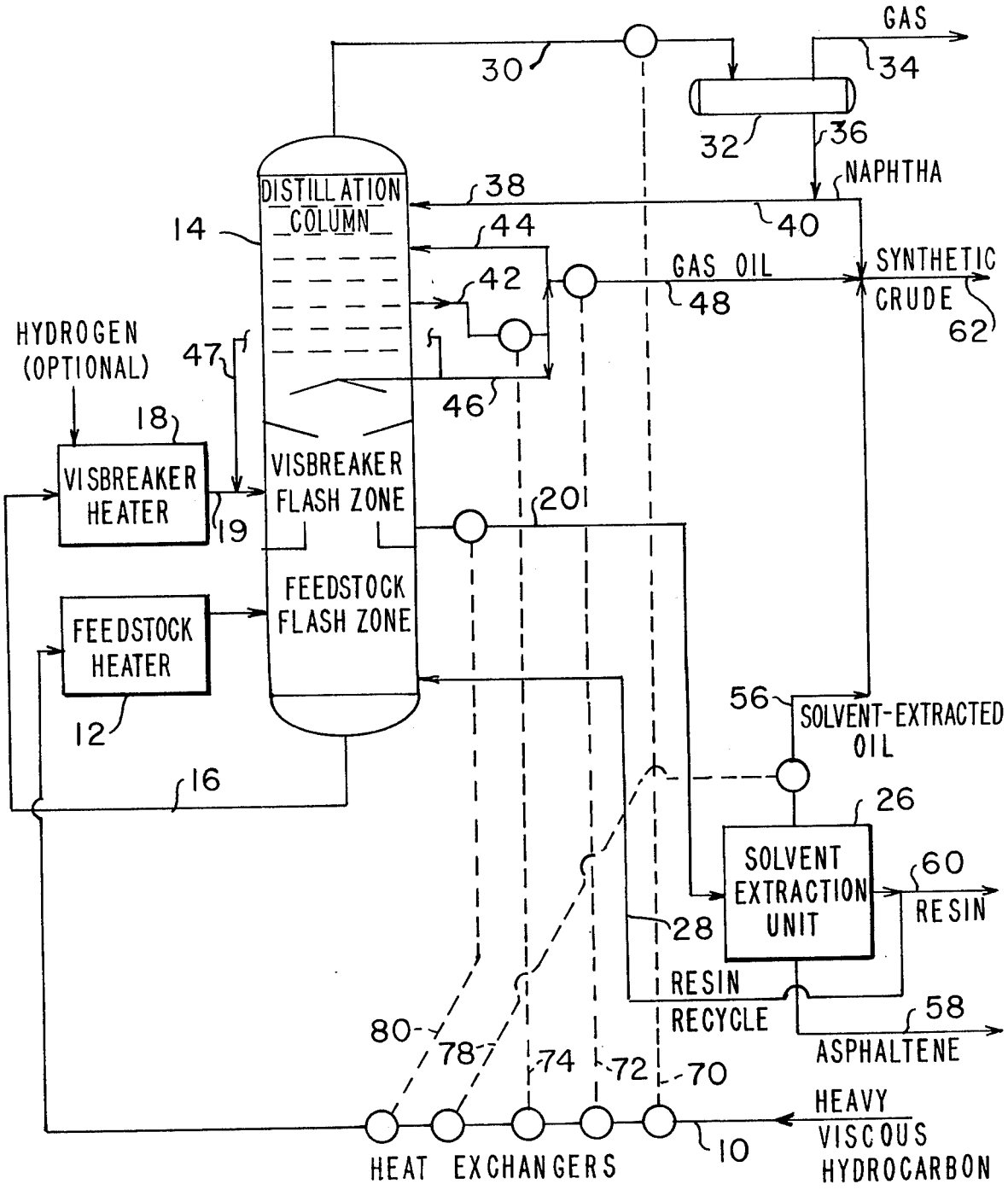
FIG. 2 is a flow diagram of a modified process for upgrading hydrocarbons in accordance with the invention. It is particularly suitable for smaller units which process crude oils which have a significant amount of lighter fractions in the oil.

A modified process which would be more suitable for smaller units which process crude oils which have a significant amount of lighter fractions in the oil is shown in FIG. 2. A heavy viscous hydrocarbon input or feedstock in line 10 is fed through conventional preheat exchangers 70, 72, 74, 78, and/or 80 and/or a feedstock heater 12 into a feedstock flash zone in a lower portion of a distillation column 14. Feedstock flash bottoms withdrawn in line 16 are passed through a visbreaker heater 18 and then into a visbreaker flash zone or intermediate zone of the distillation column 14. Bottoms from the visbreaker flash zone are withdrawn in line 20 and supplied to solvent extraction unit 26. The solvent extraction unit 26 produces a stream which contains a resin product at least a portion of which is combined with the material forming the feed for the visbreaker furnace 18; for example, the resin in line 28 is fed into the bottom of the distillation column 14 for combining with the feedstock bottoms which are subsequently withdrawn in line 16 to feed the visbreaker heater 18. Gas and naphtha are withdrawn in line 30 as overhead from the distillation column 14 and separated by the separator 32 into a gas stream in line 34 and a naphtha stream in line 36. A portion of the naphtha stream in line 36 is fed back to the top of the column 14 by line 38 as a reflux stream while the remaining portion forms a naphtha product in line 40. Gas oil is withdrawn in a side stream in line 42 from the distillation column 14, with portions in lines 44 and 46 being supplied back to the distillation column as reflux streams. Part of stream 46 may be used as a quench 47 for the transfer line 19 from the visbreaker heater. The remaining portion of the light gas oil forms a product stream in line 48. Where a three-stage solvent extraction unit is employed as shown in FIG. 2, the solvent extraction unit 26, in addition to the resin stream in line 28, produces a solvent-extracted oil stream in line 56 and an asphaltene product stream in line 58. A portion of the resin may be withdrawn as a product stream in line 60. The product streams 40, 48, and 56 may be used individually, or may be combined as shown in FIG. 2 to form a single synthetic crude product stream in line 62.

The visbreaker heater may be of conventional coil only or coil plus soaking drum design or of any other available type. The term visbreaker heater as used herein includes all equipment associated with the visbreaker including the soaking drum where utilized but excluding the fractionator. The visbreaker heater heats the feedstock flash zone bottoms which includes the recycled resins to a temperature in the range from about 850° F. to 920° F. (454° to 493° C.). Generally a temperature near the lower end of the range will be utilized in the soaking drum type visbreaker whereas a temperature near the higher end of the range will be employed in coil type visbreaking. The conversion within the visbreaker heater 18 is limited to avoid coke formation.

Adding hydrogen to the visbreaking process improves yields. It also may be added to act as a chain reaction quench, to control feedstock residence time in the coil, to increase the amount flashed at the entrance of the distillation column, and to achieve some desulfurization. The preferred hydrogen addition point is usually near the furnace coil outlet where its chain-quenching effect is important in reducing coke formation. Alternatively, in some cases, it may be possible to absorb sufficient hydrogen in the preheated liquid feed before pumping to pressure to supply the amount of hydrogen required for chain-quenching. However, the hydrogen, if added, may be introduced at any point in the visbreaking process, depending on operating conditions and operator preference.

In the distillation column 14, the visbreaker effluent flashes up to a cut point as high as 840° F. (449° C.), depending on the temperature and hydrocarbon partial pressure in the visbreaker flash zone. The cut point and temperature in the visbreaker flash zone are selected as high as the coking tendency of the hydrocarbon will permit.

Figure 3:
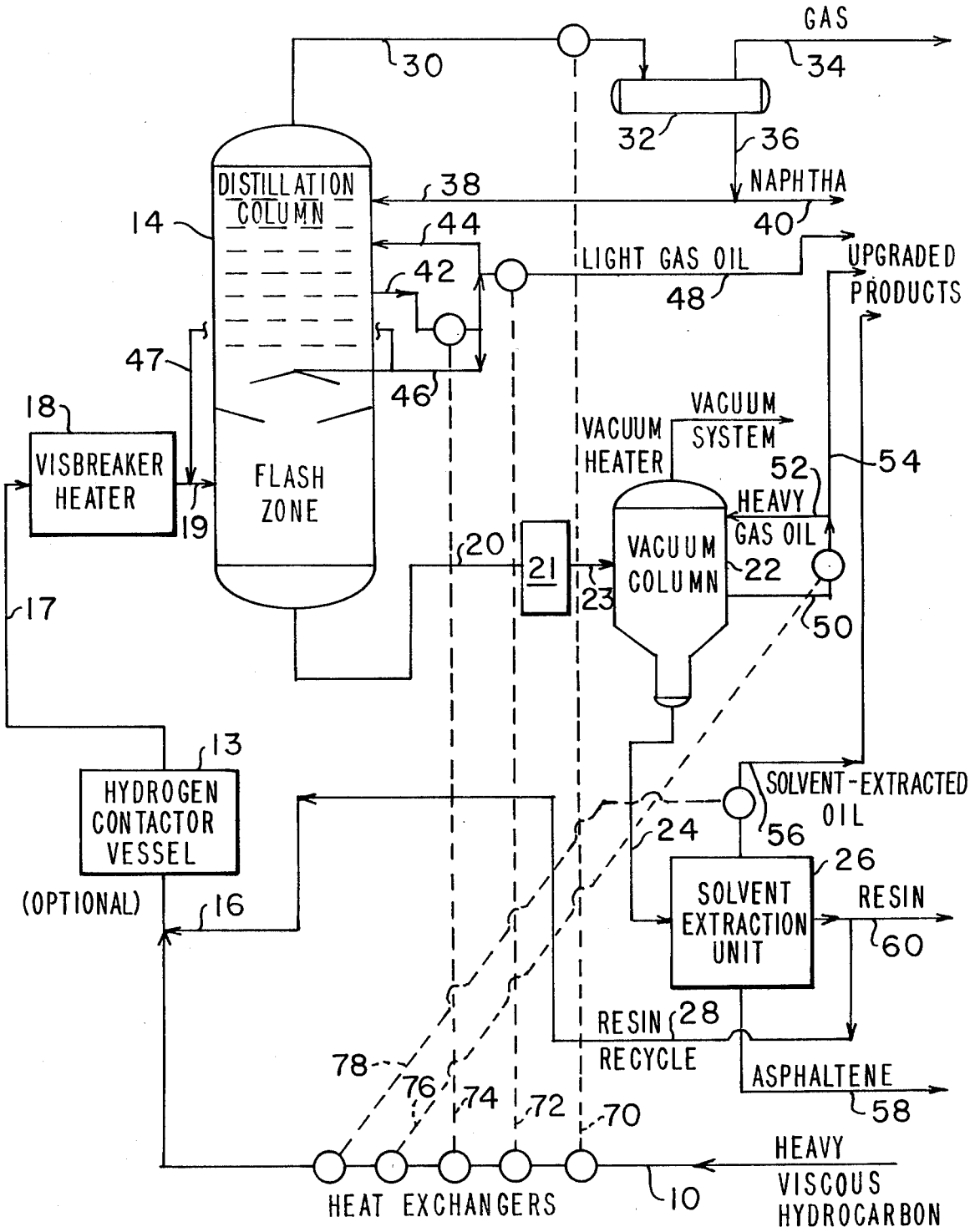
FIG. 3 is a flow diagram of another modified process for upgrading hydrocarbons in accordance with the invention. It includes a vacuum column for reducing the amount of material which must be processed in the solvent extraction unit. However, because it does not have a crude or feedstock heater, it is particularly suitable for larger units which process heavy viscous hydrocarbons that do not have a significant percentage of compounds boiling below 650° F. (343° C.).

In order to minimize the size of the solvent extraction unit or to design to meet the capacity of an existing solvent extraction unit, a vacuum tower and vacuum heater may be added. To minimize the capital cost where the feedstock to the process is derived from bottoms, or other viscous heavy hydrocarbon where an initial topping is not particularly advantageous, the crude heater and crude flash zone in the distillation column 14 may be eliminated and the flow scheme as shown in FIG. 3 may be utilized.

The heavy viscous hydrocarbon feedstock in line 10 is fed through preheat exchangers to an optical hydrogen contactor vessel and then through a visbreaker heater 18 to the flash zone in the distillation column 14. Bottoms from the flash zone are withdrawn in line 20 and are at least partially vaporized in a vacuum heater 21 and are then fed through line 23 into a vacuum column 22. Use of the vacuum heater will increase the cut point of the heavy gas oil and decrease the amount of the bottoms from the vacuum column through line 24. This will decrease the required size of the solvent extraction unit 26. The solvent extraction unit 26 produces a stream which contains resin product at least a portion of which is combined with the material forming the feed for the visbreaker heater 18. Gas and naphtha are withdrawn in line 30 as overhead from the distillation column 14 and separated by the separator 32 into a gas stream in line 34 and a naphtha stream in line 36. A portion of the naphtha stream in line 36 is fed back to the top of the distillation column 14 by line 28 as a reflux stream while the remaining portion forms a naphtha product in line 40. Light gas oil is withdrawn in a side stream in line 42 from the distillation column 14 with portions in lines 44 and 46 being supplied back to the distillation column as reflux streams. Part of stream 46 may be used as a quench 47 for the transfer line 19 from the visbreaker heater. The remaining portion of the light gas oil forms a product stream in line 48. The liquid side stream from the vacuum column 22 is withdrawn as a heavy gas oil stream in line 50, a portion of which is recycled back as a reflux stream 52 with the remainder forming a product stream in line 54. Where a three-stage solvent extraction unit is employed as shown in FIG. 3, the solvent extraction unit 26, in addition to the resin stream in line 28, produces a solvent-extracted oil stream in line 56 and an asphaltene product stream in line 58. A portion of the resin may be withdrawn as a product stream in line 60. The product streams 40, 48, 54 and 56 may be used individually, or may be combined to form one synthetic crude or several upgraded product streams. Conventional heat exchangers 70, 72, 74, 76 and/or 78 may be provided to recover process heat from the distillation column overhead, light gas oil product, light gas oil pumparound, vacuum column pumparound, and the solvent-extracted oil stream, respectively. As an alternate to adding hydrogen to the streams in the visbreaker heater, hydrogen may be added to the visbreaker feed streams 10, 16, or as shown in FIG. 3, 17. A contractor vessel 13 may optionally be utilized for this or the hydrogen may be added directly in the pipeline.

Figure 4:
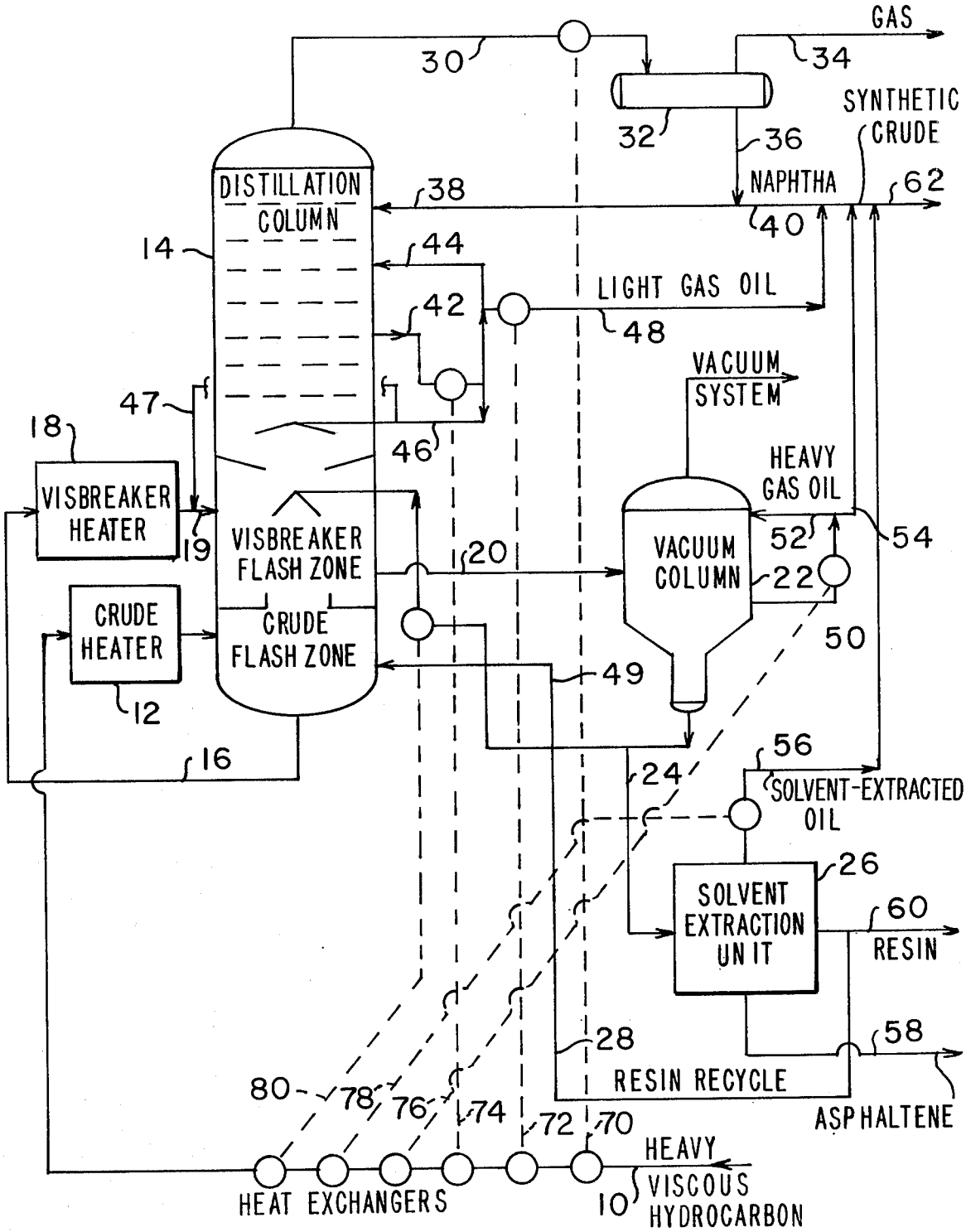
FIG. 4 is a flow diagram of another modified process for upgrading hydrocarbons in accordance with the invention. It is particularly suitable for larger units processing crude oils.

A typical flow scheme for upgrading heavy viscous crudes such as Cold Lake, Athabasca, Lloydminister, Tia Juana, Pesado or Lagotreco, is shown in FIG. 4. The hydrocarbon feedstock is heated to a temperature in the range from about 650° to 700° F. (343° to 371° C.). Conventional heat exchangers 70, 72, 74, 76, 78 and/or 80 may be provided to recover process heat from distillation column overhead, light gas oil product, light gas oil pumparound, vacuum column pumparound, solvent-extracted oil stream, and vacuum bottoms recycle, respectively. Additional heating then occurs within the crude heater 12 to bring the feedstock to the desired flash temperature for the distillation column 14.

Crude flash bottoms withdrawn in line 16 are passed through the visbreaker heater 18 and then into a visbreaker flash zone or intermediate zone of the distillation column 14. Bottoms from the visbreaker flash zone are withdrawn in line 20 and flashed as deeply as economically feasible within the adiabatic vacuum column 22. A 950° F. (510° C.) cut point can usually be obtained at a 40 mm hydrocarbon partial pressure where the feed from the bottoms of the visbreaker flash zone contains only material with a boiling point above 650° F. (343° C.) and with its temperature at about 750° F. (399° C.). For minimum cost design, the cut point in the visbreaker flash zone of the distillation column 14 is selected to be as high as practical to minimize the size of the vacuum column 22. This will result in a reduction in the quantity of vacuum bottoms being sent by line 24 to the solvent extraction unit 26. The three-stage solvent extraction unit 26 produces a resin product at least a portion of which is combined with the material forming the feed for the visbreaker heater 18; for example, the resin in line 28 is fed into the bottom of the column 14 for combining with the crude bottoms which are subsequently withdrawn in line 16 to feed the visbreaker heater 18. Gas and naphtha are withdrawn in line 30 as overhead from the distillation column 14 and separated by the separator 32 into a gas stream in line 34 and a naphtha stream in line 36. A portion of the naphtha stream in line 36 is fed back to the top of the column 14 by line 38 as a reflux stream while the remaining portion forms a naphtha product in line 40. Light gas oil is withdrawn in a side stream in line 42 from the distillation column 14 with portions in lines 44 and 46 being supplied back to the distillation column 14 as reflux streams. Part of stream 46 may be used as a quench 47 for the transfer line 19 from the visbreaker heater 18. In lieu of or in addition to quench 47, vacuum bottoms may be recycled to the visbreaker flash zone through line 49 or heavy gas oil may be used as a quench. The choice of quench schemes will depend on the feedstock characteristics and operator preference. The remaining portion of the light gas oil forms a product stream in line 48. The liquid sidestream from the vacuum column 22 is withdrawn as a heavy gas oil stream in line 50, a portion of which is recycled back as a reflux stream 52 with the remainder forming a product stream in line 54. The three-stage solvent extraction unit 26 shown in FIG. 4, in addition to the resin stream in line 28, produces a solvent-extracted oil stream in line 56 and an asphaltene product stream in line 58. A portion of the resin may be withdrawn as a product stream in line 60. The product streams 40, 48, 54 and 56 may be used individually, or may be combined to form a single synthetic crude product stream.

The improved process of the present invention renders possible the obtaining of residual and gas-free product yields greater than other nonhydroprocessing schemes and comparable to processes employing high pressure hydroconversion. The prior art hydroconversion processes are much more costly both from an investment and operating standpoint, particularly due to catalyst cost, when compared with the present invention. Synthetic crude yield of prior art delayed coking processes are typically 5 to 7% by weight less on feed than the present invention, and the synthetic crude yield of prior art fluid coking processes are typically 2 to 4% by weight less.

The increase in resin content of the feed to the visbreaker heater 18 is principally responsible for the substantially increased yields of the present invention. The resins are found to act as peptizing agents and keep the very high molecular weight asphaltenes suspended. This maintenance in suspension of asphaltenes reduces the coking tendency in the visbreaker heater enabling a substantial increase in the conversion within the visbreaker heater without coking. Thus, a substantially higher conversion can be obtained in the visbreaker than without resin recycle. A high yield of synthetic crude of good quality is thus obtained utilizing relatively inexpensive thermal conversion rather than the more expensive hydroconversion processes.

Another advantage of the present invention is that the synthetic crude or products are relatively low in metal content and thus can be handled by conventional downstream processing such as catalytic cracking or hydrocracking. Metals content of some heavy crudes, such as Boscan and Cold Lake, are very high. High metals content results in catalyst dectivation due to pore plugging and screening of catalytically active sites if these high metal feeds are charged to a catalytic process. Thus prior art processes utilizing catalytic hydroconversion for primary conversion incur large catalyst costs due to the high metals content.

When using normal pentane solvent extraction to deasphalt a crude, it is possible to obtain a yield of 57.6% oil plus resin; however, the oil plus resin contains 90 ppm of nickel plus vanadium. By reducing the yield of oil plus resin to 44% with normal pentane solvent, the metals content may be reduced to 51 ppm. The resin fraction contains approximately five times as much metal as the oil fraction. Thus recycling of the resin fraction results in substantially further reduction in metal content while substantially increasing maximum yield. Thus by proper control of the solvent extraction procedure coupled with resin recycle through the visbreaker, substantial reduction in metal contents of synthetic crude is obtained while the yield is maintained.

Still another advantage of the invention is the avoidance of cooling and reheating during process flow. The feeds to the distillation column 14 are progressively heated, and, except where a vacuum heater is employed, the flows from the distillation column generally are progressively cooled resulting in substantially lower utility costs. Depending on the choice of solvent extraction scheme, some heating may also be required within the solvent extraction unit. Prior art hydroconversion processes generally require reheating and cooling producing substantially increased utility costs. Prior art delayed and fluid coking processes can be integrated to produce progressive heating and cooling similar to the present invention; however, the synthetic crude yield of such processes is substantially less than the present invention.

Further the present process offers advantages from the standpoint of hydrogen conservation. The recycle resins typically have a hydrogen content 15 to 20% higher than asphaltenes; the hydrogen content of a typical resin is 9.8 to 10.2% by weight, while asphaltenes have a hydrogen content of only 8.2 to 8.7% by weight. Thus a desirable greater hydrogen presence during thermal visbreaking is maintained. The bromine number, which measures the olefinic content, of a product from a fluid coking process is typically more than twice as high as that of a product produced in the present process, resulting in a much higher hydrogen consumption during subsequent hydroprocessing. A significant advantage of the process of this invention is that light hydrocarbon yields ($C_1$–$C_3$) are approximately half of those listed in the literature for severe cyclic visbreaking to achieve a comparable tar yield, and only one fourth that of fluid coking. Since light hydrocarbons contain a high percentage of hydrogen, it is apparent that the liquid product from the process of this invention has a higher hydrogen content than that of competing processes; thus, downstream hydrotreating costs are significantly less. Thus conservation of hydrogen and rejection of only the minimum hydrogen content asphaltene results in minimum downstream refining costs.

EXAMPLE 1

Several visbreaker runs were made in a visbreaker pilot plant using topped (650° F.+) Cold Lake crude oil and mixtures of this same topped crude with a composite of resin fractions obtained from solvent extraction of the products from previous visbreaker runs. The pilot plant consisted of a feed charge drum, a feed pump, metering equipment and five electric furnaces, each 4 ft. long, through which passed 0.43" ID×22'6" ft. long stainless steel tubing used as the visbreaking coil, a cooler for quenching the furnace outlet, a back pressure regulating valve, and a receiver in which all products, gas and liquid, were accumulated. Conditions for these runs, together with the characteristics of the feed and visbreaking yields are presented as Table I.

Run 1 represents a visbreaker run with no resin recycle at typical conditions for a commercial visbreaker. Run 2 is a visbreaker run with resin recycle equal to 20% of the total visbreaker feed at about the same severity as Run 1. Run 3 is a visbreaker run at higher severity than Runs 1 and 2 and with resin recycle equal to 20% of the total visbreaker feed; theory being that resins stabilize the asphaltenes in the oil and reduce coke formation in the visbreaker furnace.

TABLE I

SUMMARY OF VISBREAKING RUNS

| | Run number | | |
|---|---|---|---|
| | 1 | 2 | 3 |
| | Feed Source | | |
| | 650° F. topped Cold Lake crude | 80 parts 650° F. topped crude plus 20 parts resin | 80 parts 650° F. topped crude plus 20 parts resin |
| Feed Characteristics | | | |
| sp. gr. | 1.016 | 1.0277 | 1.0277 |
| Nickel (ppm wt) | 94 | 92 | 92 |
| Vanadium (ppm wt) | 200 | 210 | 210 |
| Ramsbottom carbon, % | 9.54 | 8.27 | 8.27 |
| Visbreaking Conditions | | | |
| ERT, sec at 800° F.* | 969 | 1048 | 1587 |
| Pressure, psig | 250 | 250 | 250 |
| Cold oil residence time above 800° F., sec | 170 | 174 | 193 |
| Furnace 1 inlet, °F. | 224 | 224 | 231 |
| Furnace 1 outlet, °F. | 503 | 503 | 505 |
| Furnace 2 outlet, °F. | 752 | 753 | 756 |
| Furnace 3 outlet, °F. | 850 | 853 | 870 |
| Furnace 4 outlet, °F. | 862 | 865 | 879 |
| Furnace 5 outlet, °F. | 874 | 874 | 889 |
| Visbreaking Products (wt %) | | | |
| Gas+ 400° F. EP gasoline | 8.4 | 9.0 | 11.0 |
| 400–650° F. | 10.2 | 9.3 | 11.0 |
| 650–950° F. | 30.0 | 22.3 | 29.6 |
| 950° F.+ | 51.4 | 59.4 | 48.4 |

*ERT is equivalent residence time at 800° F. in seconds. It is calculated by multiplying the cold oil residence time above 800° F. by the ratio of relative reaction velocities as defined by Nelson (W. L. Nelson, Petroleum Refinery Engineering. 4th Ed., FIG. 19-18, page 675) taking into consideration the temperature profile across the visbreaker coil, using the average temperature for each one foot segment of the coil above 800° F.

TABLE II

SOLVENT EXTRACTION DATA FOR 950° F.+ FRACTION FROM VISBREAKING RUNS

| | Run Number | | | | | | | | | | | |
|---|---|---|---|---|---|---|---|---|---|---|---|---|
| | 1 | | | | 2 | | | | 3 | | | |
| | Fraction | | | | | | | | | | | |
| | 950° F. + Extraction Feed | Asphaltene | Resin | Oil | 950° F. + Extraction Feed | Asphaltene | Resin | Oil | 950° F. + Extraction Feed | Asphaltene | Resin | Oil |
| Wt % on Visbreaker Feed | 51.4 | 21.8 | 6.8 | 22.8 | 59.4 | 23.9 | 11.6 | 23.9 | 48.4 | 22.0 | 9.5 | 16.9 |
| Sp. gr. @ 60° F. | 1.095 | 1.212 | 1.055 | 1.003 | 1.091 | 1.214 | 1.056 | 1.077 | 1.113 | 1.217 | 1.074 | 1.016 |
| Nickel, ppm wt | 181 | 350 | 90 | 18 | 154 | 330 | 52 | 13 | 190 | 360 | 70 | 18 |
| Vanadium, | 385 | 850 | 150 | 33 | 342 | 760 | 105 | 25 | 440 | 870 | 145 | 37 |

TABLE II-continued

SOLVENT EXTRACTION DATA FOR 950° F.+ FRACTION FROM VISBREAKING RUNS

| | Run Number | | | | | | | | | | | |
|---|---|---|---|---|---|---|---|---|---|---|---|---|
| | 1 | | | | 2 | | | | 3 | | | |
| | Fraction | | | | | | | | | | | |
| | 950° F. + Extraction Feed | Asphaltene | Resin | Oil | 950° F. + Extraction Feed | Asphaltene | Resin | Oil | 950° F. + Extraction Feed | Asphaltene | Resin | Oil |
| ppm wt Conradson Carbon, wt % | 29 | 50 | 29 | 10.2 | 29 | 50 | 28 | 10.9 | 35 | 52 | 33 | 11.3 |
| Sulfur, wt % | 5.8 | 7.3 | 5.3 | 4.2 | 5.8 | 7.1 | 5.4 | 4.7 | 6.0 | 7.3 | 5.4 | 4.6 |

Solvent extraction data for 950° F.+ fraction from the various visbreaker runs are presented in Table II. Asphaltenes were determined by mixing a finely ground sample of the 950° F.+ fraction with 20 volumes of n-pentane per volume of sample at room temperature for six hours; the undissolved material was filtered using fine filter paper and washed with fresh n-pentane until the filtrate was clear. After evaporating the n-pentane on the surface of the undissolved material in a stream of nitrogen at low temperature, the material was weighed and reported as the asphaltene yield of the 950° F.+ fraction. The n-pentane in the filtrate from the previously described determination of asphaltenes was evaporated to bring the solvent/feed ratio back to 20/1. The resultant material was charged to a closed vessel equipped with a valve which was then attached to an apparatus which provided agitation by mechanical rocking and which was fitted with a heating mantle with close temperature control. The temperature was raised to 375° F. and a resin phase was withdrawn. The resin and oil yields were determined by evaporating the n-pentane solvent from the respective fractions. From analysis of the resin fraction, it should be noted that the resin is very high in metals (157–240 ppm wt) and would not be a good hydrocracker or hydrotreater feed.

Using the yield data of Run 2 and subtracting 80% of the yield data of Run 1, yield data for the recycled resin can be derived. This calculation is shown in Table III. It should be noted that at approximately the same severity as Run 1, for Run 2 the resin went approximately half to asphalt and half to solvent extracted oil. The apparent negative yield from recycle resin of the 650°–950° F. fraction in Run 2 is probably accounted for by experimental error.

The most important aspect of visbreaking is the conversion of the 950° F.+ material to lower boiling products and products with lower contents of Conradson carbon and metals. Table IV presents a summary of the results of Runs 1, 2, and 3 with respect to the disposition of the 650° F.+ fractions. Several important observations and conclusions can be drawn from the information in Table IV together with the information in Table II.

TABLE III

YIELD DATA(1) CALCULATION FOR RECYCLED RESIN RUN NO. 2

| | Run No. 2 Yield from 80 parts parts 650° F.+ and 20 parts resin | Yield from 80 650° F.+ based on Run No. 1 | Recycled Resin Yield (by difference) | Converted Resin Yield Wt. % |
|---|---|---|---|---|
| $C_3$-Gas | 1.4 parts | 1.0 parts | .40 parts | 2.9 |
| $C_4$-400° F. | 7.6 | 5.7 | 1.9 | 13.5 |
| 400° F.–650° F. | 9.3 | 8.2 | 1.1 | 8.3 |
| 650° F.=950° F. | 22.3 | 24.1 | −1.8 | −13.0 |
| Asphaltene(2) | 23.9 | 17.4 | 6.5 | 47.0 |
| Resin(2) | 11.6 | 5.4 | 6.2 | — |
| Oil(2) | 23.9 | 18.2 | 5.7 | 41.3 |
| | 100.0 parts | 80.0 parts | 20.0 parts | 100.0 |

Notes:
(1)Parts refer to parts by weight.
(2)Yield of oil, resin, and asphaltene determined by solvent extraction of 950° F.+ fraction using n-pentane solvent.

TABLE IV

DISPOSITION OF THE 650° F.+ FRACTION IN VISBREAKING RUNS

| | Run 1 (Parts by Weight) ERT = 969 | | | Run 2 (parts by Weight) ERT = 1048 | | | Run 3 (Parts by Weight) ERT = 1587 | | |
|---|---|---|---|---|---|---|---|---|---|
| | Feed | Product | Product/Feed | Feed | Product | Product/Feed | Feed | Product | Product/Feed |
| Total 650° F.+ | 100.0 | 81.4 | 0.814 | 100.0 | 81.7 | 0.817 | 100.0 | 78.0 | 0.78 |
| 650° F.–950° F. | 31.4 | 30.1 | 0.96 | 26.2 | 22.3 | 0.85 | 26.2 | 29.6 | 1.13 |
| 950° F.+ | 68.6 | 51.3 | 0.75 | 73.8 | 59.4 | 0.80 | 73.8 | 48.4 | 0.66 |
| Asphaltene | (19) | (21.9) | (1.15) | (15.8) | (23.9) | (1.51) | (15.8) | (22) | (1.39) |
| Resin | (20) | (6.8) | (0.34) | (33.3) | (11.6) | (0.35) | (33.3) | (9.5) | (0.29) |

TABLE IV-continued

DISPOSITION OF THE 650° F.+ FRACTION IN VISBREAKING RUNS

| | Run 1 (Parts by Weight) ERT = 969 | | | Run 2 (parts by Weight) ERT = 1048 | | | Run 3 (Parts by Weight) ERT = 1587 | | |
|---|---|---|---|---|---|---|---|---|---|
| | Feed | Product | Product/ Feed | Feed | Product | Product/ Feed | Feed | Product | Product/ Feed |
| Oil | (29.6) | (23.0) | (0.78) | (24.7) | (23.9) | (0.97) | (24.7) | (16.9) | (0.68) |

(1) The resin fraction has the highest conversion rate of the various fractions, approximtely ten times greater than the average of the high molecular weight oils. For Runs 1 and 2, at about the same severity, about 65% of the resin is converted and for Run 3 at the higher severity, 71% is converted.

(2) At the higher severity of Run 3 compared to Run 2, and with the same feedstock including recycle resin, the following observations can be made:

(a) That the asphaltene yield is lower (1.39 parts/part feed compared to 1.51 parts/part feed) at the higher severity of Run 3. This illustrates the synergism resulting from resin recycle because a higher yield of asphaltene would be expected at higher severity without resin recycle.

(b) That the yield of 950° F.+ solvent extracted oil is 0.68 parts/part of feed for Run 3 compared to 0.97 parts/part of feed for Run 2. This result indicates that the 950° F.+ oil fraction is converted to more useful lower boiling products at the higher severity without resulting in a higher asphaltene yield.

(c) That the 650°–950° F. fraction shows an increase for Run 3, 1.13 parts/part of feed, compared to 0.85 parts/part of feed for Run 2. This confirms that the 950° F.+ fractions of asphaltenes, resins, and oil are converted to a greater percentage of useful lower boiling fractions at the higher severity.

(3) The Conradson carbon content as well as the metals content of the 950° F.+ solvent extracted oil for the test runs with resin recycle range from 10.9% to 11.3% and 38 ppm to 56 ppm, respectively.

These values are high for a good feedstock to downstream catalytic processes such as catalytic cracking or hydrocracking. The quality of the solvent extracted oil could be greatly improved, e.g., to 3 to 4% Conradson carbon and 10 to 20 ppm metals, by using a lighter solvent such as isobutane or propane rather than n-pentane. The use of the lighter solvent would reduce the per pass oil yield; however, taking into consideration that resin is recycled to extinction, the overall yield of the higher quality 950° F.+ oil and lower boiling products would be the same or higher as compared to the n-pentane solvent cases. This additional resin recycle can be accomplished with minimal effect on the capital and operating costs of the unit.

A further extension of this concept would be to produce a combined resin and oil fraction from the 950° F.+, or 1050° F.+ by revising vacuum column operating conditions, material and recycle that fraction to extinction; in this case there would be zero yield of the 950° F.+, or 1050° F.+, oil and all products, other than the asphaltene fraction, would be distillate products very low in Conradson carbon and metals content.

EXAMPLE 2

By utilizing pilot plant data, one can calculate the product yields of a process performed in accordance with the invention. 20,000 barrels per day of 10.8° API Cold Lake crude are upgraded in the process as illustrated in FIG. 4. The recycle bottoms in line 16 have a boiling point greater than 650° F. (343° C.). The bottoms from the visbreaker flash zone in line 20 have a boiling point above 700° F. (371° C.). The naphtha in line 36 has a boiling point less than 400° F. (204° C.) while the boiling range for the light gas oil in line 48 is in the range from 400° to 700° F. (204° to 371° C.). The heavy gas oil in line 54 has a boiling point in the range from 700° to 950° F. (371° to 510° C.). The synthetic crude product in line 62 forms a stream of about 17,360 barrels per day or approximately 86.8% volume of the feedstock at 21.8° API and 20 centistokes viscosity at 100° F. In the total output, the gas in line 34 forms about 1.3% by weight, the naphtha in line 40 forms about 13.2% by volume, the light gas oil in line 48 is about 30.8% by volume, the heavy gas oil in line 54 is about 22.3% by volume, the solvent-extracted oil in line 56 is about 20.5% by volume, and the asphaltene in line 58 is about 14.9% by volume of the total input. About 4.9% of the total volume is recycled in line 28 as resin.

Since many modifications, variations and changes in detail may be made to the process described above, it is intended that all matter described in the foregoing description and shown in the accompanying drawings be interpreted as illustrative and not in a limiting sense.

What is claimed is:

1. In an improved process for upgrading heavy viscous hydrocarbons which includes visbreaking the heavy viscous hydrocarbons or portion thereof in a visbreaker heater with or without a soaking drum, fractionating the visbreaker heater output in a distillation step, and solvent processing a heavier fraction from the distillation step in a solvent extraction step to form two or more fractions including a heavier fraction containing a large percentage of asphaltenes and one or more lighter fractions containing a large percentage of resins and oils; the improvement comprising the steps of combining at least a portion of one of the lighter fractions which contains resins from the solvent extraction step with the heavy viscous hydrocarbons which are to be subject to visbreaking whereby the resin content thereof is increased, and withdrawing lighter fractions from the process to form one or more upgraded products.

2. The improvement as claimed in claim 1 including vacuum flashing in a vacuum distillation step the heavier fraction from the first distillation step prior to solvent extraction of the heavier fraction to reduce the quantity of heavier fraction subjected to solvent extraction, and wherein the withdrawing of the ligher fractions includes withdrawing a lighter fraction from the vacuum distillation step.

3. The improvement as claimed in claim 2 including heating the feed to the vacuum distillation step to further reduce the amount of heavier fraction subjected to solvent extraction.

4. The improvement as claimed in claim 1 wherein said lighter fractions have liquid and gaseous portions, and wherein the withdrawn lighter liquid fractions from the distillation step and the solvent extraction step are combined to form a single synthetic crude product.

5. The improvement as claimed in claim 2 wherein said lighter fractions have liquid and gaseous portions, and wherein the withdrawn lighter liquid fractions from the distillation step, vacuum distillation step, and the solvent extraction step are combined to form a single synthetic crude product.

6. The improvement as claimed in claim 1 comprising the further steps of heating the viscous hydrocarbon, and fractionating the heated viscous hydrocarbon; and wherein at least a portion of a heavy fraction from the viscous hydrocarbon fractionating step forms at least a substantial portion of the feed to the visbreaker heater.

7. The improvement as claimed in claim 6 wherein the visbreaker heater output fractionating and the viscous hydrocarbon fractionating are at least partially performed in the same distillation column, the visbreaker heater output charge and the viscous hydrocarbon charge being fed to respective flash zones of the distillation column.

8. The improvement as claimed in claim 7 wherein the heavier fraction charge to the solvent extraction step is taken from a bottoms output of the visbreaker heater output flash zone of the distillation column.

9. A process for upgrading a heavy viscous hydrocarbon comprising the steps of:

visbreaking at least a portion of the heavy viscous hydrocarbon in a visbreaker heater;

fractionating the output of the visbreaker heater;

solvent extracting at least a portion of a heavier fraction from the fractionating step to form at least one lighter fraction containing resins and a heavier fraction rich in asphaltenes;

combining at least a portion of a lighter fraction containing resins from the solvent extracting step with the charge to the visbreaker heater whereby the resin content thereof is substantially increased; and withdrawing lighter fractions from the process to form one or more upgraded products.

10. A process as claimed in claim 9 wherein the visbreaking step includes adding hydrogen to the heavy viscous hydrocarbon.

11. A process as claimed in claim 9 wherein the heavy viscous hydrocarbon is selected from viscous crude oils, bitumens from tar sands, hydrocarbons derived from coal, lignite, peat or oil shale, residuum resulting from the vacuum or atmospheric distillation of lighter crude oils, or heavy residue from a solvent extraction process.

12. A process as claimed in claim 9 including the further steps of heating the viscous hydrocarbon, and fractionating the heated viscous hydrocarbon; and wherein at least a portion of a heavy fraction from the viscous hydrocarbon fractionating step forms at least a substantial portion of the feed to the visbreaker heater.

13. A process as claimed in claim 12 wherein the visbreaker heater output fractionating and the viscous hydrocarbon fractionating are at least partially performed in the same distillation column, the visbreaker heater output charge and the viscous hydrocarbon charge being fed to respective flash zones of the distillation column.

14. A process as claimed in claim 13 wherein the heavier fraction charge to the solvent extraction step is taken from a bottoms output of the visbreaker flash zone of the distillation column.

15. A process as claimed in claim 9 including vacuum flashing in a vacuum distillation step the heavier fraction from the fractionating step prior to the solvent extraction step to reduce the quantity of heavier fraction subjected to solvent extraction, and wherein the withdrawing of the lighter fractions includes withdrawing a lighter fraction from the vacuum distillation step.

16. A process as claimed in claim 15 including heating the feed to the vacuum distillation step to further reduce the amount of heavier fraction charge to the solvent extraction step.

17. A process as claimed in claim 15 wherein the withdrawn lighter fractions from the fractionating step, the vacuum distillation step, and the solvent extraction step are combined to form a single synthetic crude product.

18. A process as claimed in claim 9 wherein said lighter fractions have liquid and gaseous portions, and wherein the withdrawn lighter liquid fractions from the fractionating step and the solvent extraction step are combined to form a single synthetic crude product.

19. A process as claimed in claim 9 wherein the solvent extraction step produces two fractions, one rich in asphaltenes and a second fraction rich in resins and solvent-extracted oils, wherein the entire second fraction rich in resins and solvent-extracted oils is combined with the charge to the visbreaker heater so that said resins and solvent-extracted oils are converted to materials boiling below 1050° F. (565° C.) and to asphaltenes.

20. A process as claimed in claim 9 wherein the solvent extraction step employs a solvent selected from propane, butane, pentane, hexane, heptane, octane, nonane, propene, butene, pentene, hexene, heptene, octene, nonene, benzene, toluene, ortho-xylene, meta-xylene, para-xylene, and isopropyl benzene, or mixtures thereof.

21. A process as claimed in claim 9 wherein the solvent extraction step contains three stages to produce an asphaltene rich fraction, a resin rich fraction, and an oil rich fraction and employs a solvent selected from propane, isobutane, normal butane, propylene, butene, isopentane, or mixtures thereof to reduce the per pass yield of the oil rich fraction from the solvent extraction step to reduce the oil rich fraction's metals and Conradson carbon content and wherein the resin rich fraction is combined with the charge to the visbreaker heater to obtain upgraded products of a superior quality.

* * * * *